United States Patent [19]

Rucker

[11] Patent Number: 4,497,251

[45] Date of Patent: Feb. 5, 1985

[54] LIQUID-DISABLED BLASTING CAP

[75] Inventor: Klaus G. Rucker, Kinnelon, N.J.

[73] Assignee: E. I. Du Pont de Nemours and Company, Wilmington, Del.

[21] Appl. No.: 469,954

[22] Filed: Feb. 25, 1983

[51] Int. Cl.[3] ..... F42B 3/10

[52] U.S. Cl. ..... 102/202.6

[58] Field of Search ..... 102/202.6; 86/1, 10

[56] References Cited

U.S. PATENT DOCUMENTS

| | | | |
|---|---|---|---|
| 1,901,469 | 3/1933 | Piccard | 102/202.6 |
| 2,739,535 | 3/1956 | Rolland et al. | 102/202.6 |
| 2,759,417 | 8/1956 | O'Neill | 102/202.6 |
| 2,891,477 | 6/1959 | Swanson | 102/202.6 |
| 3,372,640 | 3/1968 | Dow et al. | 102/202.6 |

*Primary Examiner*—Charles T. Jordan

[57] ABSTRACT

A liquid-disabled blasting cap, especially useful in oil well perforation assemblies, has a perforated cap shell and a porous tubular member, e.g., a ceramic, adjacent the perforations. An ignition charge is present in the bore of the porous tubular member and in the cap's ignition train. The porous tubular member allows disabling liquids to be transferred to the ignition train from outside the cap through the holes in the shell wall, while at the same time acting as a protective barrier element between the holes and the ignition and explosive charges. In oil well caps, a $B/Fe_2O_3$ ignition powder is preferred because of its high-temperature stability.

13 Claims, 1 Drawing Figure

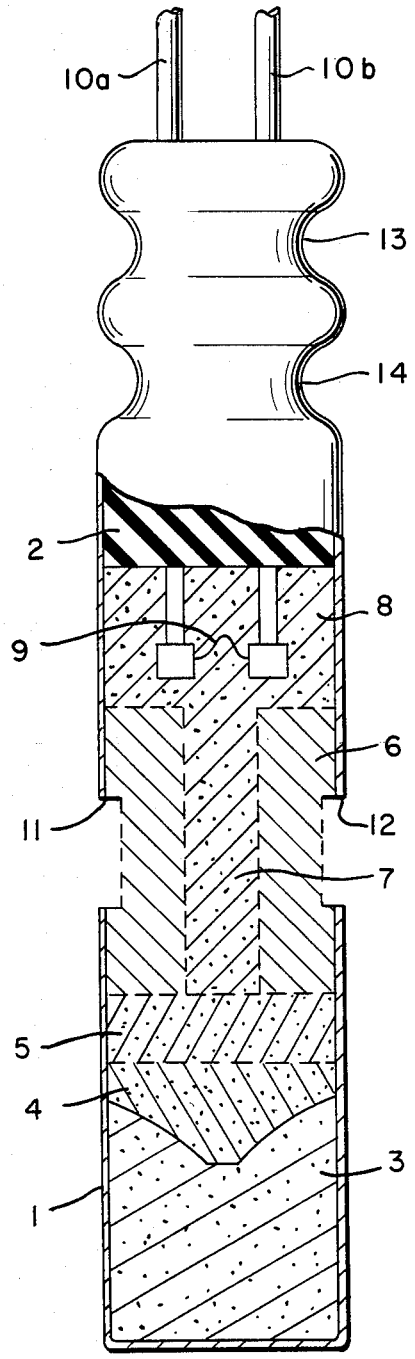
10a
10b
13
14
2
8
9
6
11
12
7
5
4
3
1

LIQUID-DISABLED BLASTING CAP

BACKGROUND OF THE INVENTION

1. Field of the Invention

The present invention relates to blasting caps, and more particularly to blasting caps which function in air but are inoperative in liquids such as water and oil. The invention relates also to a heat-sensitive exothermic-burning composition useful as an ignition charge for blasting caps.

2. Description of the Prior Art

U.S. Pat. Nos. 2,739,535, 2,759,417, and 2,891,477 describe the use of lined shaped charges of high-velocity detonating explosive to perforate oil well casings and the walls of oil wells. The shaped charges are mounted in a reusable perforating gun, and ordinarily are initiated by detonating cord, which in turn is initiated by a blasting cap, usually electric, located in the carrier gun. The lined cavity of the shaped charges must be free of substantially incompressible material which would interfere with the "jetting" action required for effective penetration of the casing. If a liquid such as water or oil enters the gun and the charges are detonated while the space surrounding them is filled with the liquid, the perforating gun may become damaged and permanently wedged in the oil well casing. To prevent this from happening, initiators have been developed which are inactivated by the presence of a liquid and thereby will not permit initiation of the shaped charges in the event liquid of any kind enters the perforating gun. These initiators function on the "gap" principle, according to which a free space is provided between reactive components of a blasting cap or between the blasting cap and the detonating cord to be initiated thereby. The cap functions and the detonation is transmitted to the cord when the space is filled with air but not when it is filled with liquid.

In the blasting caps described in U.S. Pat. Nos. 2,739,535 and 2,759,417, the ignition charge is separated from the priming charge, and holes are present in the wall of the cap shell around the free space between these charges. The cap is located at the bottom of the perforating gun barrel, and liquids that leak into the barrel surround the cap and enter the holes therein, thereby preventing the ignition impulse from reaching the priming charge and inactivating the cap. One of the drawbacks of this cap is that loose live powder can fall out of the holes during manufacture and handling unless the powder is introduced as preformed pellets.

In the device shown in U.S. Pat. No. 2,891,477, a blasting cap is maintained in axial alignment with a receptor shell containing an impact-sensitive explosive charge, the closed, base-charge end of the cap facing, but being spaced apart from, the closed end of the receptor shell. When the space between shells is empty, the impact-sensitive receptor charge is initiated over the air gap by the detonation of the cap's base charge, and the receptor charge (or a booster charge adjacent thereto) initiates a detonating cord fitted into the receptor's opposite end. The means used to maintain the positioning of the cap and the receptor shell has openings in the area around the gap to permit the entry of liquids. When a liquid is present in the gap, the cap may detonate but it cannot initiate the cord because the receptor charge does not detonate. This design avoids the problem of loose powder falling out of holes surrounding the gap, but suffers from certain other disadvantages common to the "gap-type" caps. Some liquid-disabled caps of this design might be mounted in a small-diameter pipe. Such caps might detonate in liquids because the shock wave is guided by the pipe to the receptor charge in almost undiminished strength. Another disadvantage is that the discontinuity in the reaction train introduced by the gap is a possible source of malfunction (i.e., failure of the reaction to propagate from one charge to the next) when the detonating cord and shaped charges are supposed to detonate, and, in any event, limits the choice of explosives that can be used with any given set of cap specifications. For example, in the device of U.S. Pat. No. 2,891,477, a change in base charge composition to comply with use requirements may necessitate a change in base charge size, gap size, and/or receptor charge. Also, the proper functioning of such devices is dependent on achieving a high degree of precision in manufacturing with respect to gap size, and uniformity of donor and receptor charge composition and size. Such precision is difficult to achieve with standard blasting cap loading machines. Still another disadvantage is the added length of the device in contrast to standard blasting caps.

SUMMARY OF THE INVENTION

This invention provides an improvement in blasting caps of the type adapted to function in air and to fail in liquids, which blasting caps comprise a tubular metal shell integrally closed at one end and containing, in sequence, from the closed end, a base charge of a detonating explosive composition and a priming charge of a heat-sensitive detonating explosive composition, and being closed at its opposite end by an ignition assembly containing an ignition charge of a heat- or flame-sensitive exothermic-burning composition for igniting the priming charge, which ignition charge is ignitible by the delivery of electrical energy, or the application of a pressure pulse, to the blasting cap. The improvement of the invention comprises a porous tubular member or cylinder seated within the tubular metal shell between the priming charge and the ignition charge in the ignition assembly, said porous member having an axial perforation containing a substantially continuous charge of a heat-sensitive exothermic-burning composition communicating with the priming charge and with the ignition charge in the ignition assembly so as to provide a substantially continuous train of charges from the ignition charge in the ignition assembly to the base charge, the sidewall of said tubular metal shell being provided with multiple perforations adjacent the porous tubular member seated therein whereby liquids may gain access to the porous tubular member and the charge of exothermic-burning composition contained therein.

In one embodiment of the invention, the porous cylinder is made of a sintered or fired compacted powder, e.g., crushable alumina or magnesia, unglazed earthenware such as a clay, or a sintered powdered metal such as stainless steel. In a different embodiment, the porous cylinder is made of a fibrous material such as fiber glass The present invention also provides a process for making the blasting cap of the invention wherein the porous cylinder is made of a fibrous material, said process comprising:

(a) sequentially loading into a tubular metal shell from an integrally closed end thereof, a base charge of a detonating explosive composition and a priming charge of a heat-sensitive detonating explosive composition;

(b) positioning a layer of fibrous material, e.g., fiber glass, adjacent the priming charge;

(c) forcing a pin into the layer of fibrous material so as to punch an axial perforation therein and convert said layer into a tubular configuration;

(d) introducing a heat-sensitive exothermic-burning powder into the perforation;

(e) positioning at the opposite end of said tubular metal shell a plug closure and an ignition assembly including an ignition charge of a heat- or flame-sensitive exothermic-burning composition for igniting the priming charge, said ignition charge and said priming charge communicating with said powder in said perforation; and (f) punching holes in the wall of the tubular metal shell adjacent the tubular layer of fibrous material.

BRIEF DESCRIPTION OF THE DRAWING

The accompanying drawing is a side view in partial cross-section of an electrically actuated liquid-disabled blasting cap of the invention.

DETAILED DESCRIPTION

Referring to the drawing, 1 is a tubular metal (e.g., aluminum) shell, which is integrally closed at one end and closed at its opposite end by a sealing plug 2, made of a suitable solid material, e.g., rubber, and held in place by circumferential crimps 13 and 14. In sequence from the integrally closed end, shell 1 contains a base charge 3 of a detonating explosive composition, a priming charge 4 of a heat-sensitive detonating explosive composition, e.g., lead azide, and a cover layer 5 of a heat-sensitive exothermic-burning ignition charge. Seated upon cover layer 5 is a porous tube or cylinder 6, made, for example, from a sintered ceramic or metal powder or a fibrous material. The axial perforation or bore of tube 6 contains a charge 7 of a heat-sensitive exothermic-burning composition which readily absorbs aqueous and/or organic liquids and is thereby rendered incapable of burning. Superposed on tube 6 is an electrical ignition assembly comprised of heat-sensitive exothermic-burning ignition charge 8 and the therein-embedded high-resistance bridgewire 9, which is attached to the ends of lead wires 10*a* and 10*b*. As a matter of convenience, ignition charge 8 and charge 7, and also cover layer 5, can be comprised of the same, or same type of, composition, e.g., a mixture of a metal and an oxidizer.

Located in the wall of shell 1 adjacent porous tube 6 are oppositely disposed perforations 11 and 12. By means of these perforations, areas of the outer wall of tube 6 are exposed directly to the surrounding atmosphere, allowing liquids to be absorbed rapidly into porous tube 6 and to reach charge 7 and render it, and possibly the charges adjacent thereto, non-functioning. When the atmosphere surrounding the blasting cap is air, the cap is actuated in the usual manner by the application of current to lead wires 10*a*,10*b*. The hot bridge wire 9 ignites charge 8, which, in turn, is able to cause the ignition of priming charge 4 owing to the continuous train of charges 8, 7, and 5.

When the blasting cap is surrounded by a liquid, however, the liquid is absorbed by porous tube 6 through perforations 11 and 12 and reaches charge 7, the adjacent ignition charge 8, and cover layer 5, leading to the disablement of the cap. Although the route by which a cap becomes disabled is not known with certainty, and, in any event, may differ from case to case depending on environmental conditions and cap specifics, e.g., degree and size of porosity in tube 6, powder density, etc., it is possible that the soaked ignition charge may cause the bridgewire to burn out before the moist powder ignites, or the ignition charge may fail after a small degree of burning as the flame front enters moist powder regions. If the front should reach the liquid-soaked priming charge, the latter can fail, or the base charge can fail after having received only a weak initiation impulse from the liquid-weakened priming charge or after it has itself been liquid-soaked.

A critical feature of the liquid-disabled blasting cap of this invention is the porous tubular member 6, which is the vehicle by which disabling liquids are transferred to the ignition train from outside the cap through the holes in the shell wall, while at the same time it acts as a protective barrier element between these holes and the cap's ignition and explosive charges. The porous tubular member's pore structure is fine, e.g., the maximum pore size is about 0.1 millimeter, and the presence of this element adjacent the liquid-entry holes eliminates the possibility of powder loss, such as may occur in the previously described blasting caps of the prior art. In the present blasting cap, the disabling of the cap is a result of three basic features acting in concert: (a) the porous tubular member between the cap's priming and ignition charges; (b) perforations in the cap shell wall adjacent the porous tubular member; and (c) in the bore of the porous tubular member and in the cap's ignition train, a heat-sensitive exothermic-burning powder which readily absorbs aqueous and/or organic liquids and thereby becomes desensitized, i.e., incapable of burning.

Depending on the area of the cap's intended use, i.e., whether in an oil well or in the sea, for example, the porous tubular member must be readily wettable by aqueous and/or organic liquids, e.g., it must be able rapidly to soak up water, saturated salt water, kerosene, oil, etc., as the case may be. Tubular members which are penetrated by liquids at a liquid head of 5 centimeters at a rate of at least one centimeter per minute should be used. This assures the disabling of the ignition and priming charges within two minutes when the liquid head is only about 3 centimeters. High liquid pressures force the liquids into the cap and disable it within seconds.

In order that the porous tubular member afford protection against loss of the cap's active powders, the tubular member is a fine-pored, coherent element, e.g., a fired or sintered powder compact in the form of a tube, such as may be obtained by strand-extrusion. Ceramic powders, e.g., crushable alumina or magnesia, or silicates, of about 20 to 80%, preferably about 40 to 60%, porosity, are preferred. Porous earthenware, e.g., clays, with unglazed surfaces, and sintered metal powders, e.g., porous sintered stainless steel or brass, also can be used. Fibrous materials, e.g., glass fiber or organic polymers such as those which are useful for their high-temperature stability (Kevlar® and Nomex® aramid fibers are typical) also may be used to form the porous tubular member. One or more layers of the fiber can be pre-formed into a tube, which is inserted into the cap shell over the priming charge; or the tube can be formed in situ, e.g., by positioning a layer of the fibrous material adjacent the priming charge, or the protective cover charge superposed on the priming charge; and forcing a pin into the layer of fibrous material so as to punch an axial perforation therein and transform it into a tubular configuration.

If the blasting cap is intended for use in perforating systems in oil wells that are deep and hot, consideration has to be given to the thermal stability of the materials from which the cap's components are constructed, and this includes the porous tubular member. As a rule, stability at temperatures up to about 350° C. is desirable for such uses. Thus, for oil well caps, a porous tubular member made of a ceramic or metal, or a paper based on an aramid fiber is preferred.

The axial perforation, or bore, of the porous tubular member contains a substantially continuous charge of a heat-sensitive exothermic-burning composition. This is an ignition charge that communicates, directly or indirectly, with the priming charge, which is detonated by the heat produced by the burning ignition charge. In an electric blasting cap, such as the one shown in the drawing, ignition charge 7 communicates directly with the ignition charge 8 in the bridgewire-fired ignition assembly, and conveniently has the same composition, and about the same density, as charge 8. Thus, charge 7 constitutes a part of the cap's substantially continuous ignition train, carrying thermal energy to the heat-sensitive detonating explosive known as the priming charge 4. In the embodiment shown in the drawing, ignition charge 7 communicates indirectly with priming charge 4 by virtue of cover layer 5, which is a preferred, although not critical, component of the blasting cap of the invention. Cover layer 5, which is a heat-sensitive exothermic-burning powder, also an ignition charge, is useful in that it does not have the friction sensitivity of the priming explosive, e.g., lead azide, and therefore does not present the potential friction hazard of a cap having the porous tube in contact with the friction-sensitive priming explosive. In addition to sealing the priming charge off from the potentially friction-producing porous tube, the cover layer of ignition powder also assists in the liquid disablement of the cap because the ingress of liquid is faster into the low-density powdery ignition charge 5 than into the priming charge, which is highly compacted.

Any of the heat-sensitive exothermic-burning ignition compositions commonly used in bridgewire ignition assemblies in electric blasting caps can be used as ignition charge 8 in the liquid-disabled electric cap. Typical ignition compositions used include the complex salt of lead nitrate with a lead salt of a nitrophenol, a 50/25/25 mixture of smokeless powder/potassium chlorate/-dibasic lead salt of a nitrophenol, mercury fulminate, lead styphnate, lead mononitroresorcinate, tetryl/lead styphnate compositions, diazodinitrophenol-nitromannite compositions, a 2/98 boron/red lead mixture, red lead/manganese boride, lead/selenium, etc.

The heat-sensitive exothermic-burning composition 7 located in the bore of the porous tubular member also is an ignition composition in that it carries the ignition impulse to the priming charge. Although not necessary, it often will be possible to use the same, or same type of, composition for charges 7 and 8. In any case, an important consideration in the selection of the composition to be used in the ignition charge(s) for the liquid-disabled blasting cap of this invention is the degree of affinity the composition has for the liquid which is to disable the cap, i.e., how rapidly it absorbs the liquid. Another important consideration is the possibility that the composition, or a component thereof, will decompose or undergo a deleterious reaction with the absorbed liquid at temperatures expected to be encountered in the environment in which the blasting cap is to be used. For example, for oil well caps, metal/oxide ignition compositions are preferred because they are stable at higher temperatures. However, of the possible metal/oxide combinations, some may well be ruled out for oil well caps on the basis that the oxidizer therein is too vigorously reactive with absorbed hydrocarbons at the temperature attained by the hydrocarbon in the oil well, or at the temperature of the heated bridgewire. On this basis, oxidizers such as red lead ($Pb_3O_4$), potassium permanganate, potassium perchlorate, lead nitrate, and potassium nitrate preferably are used in blasting caps to be disabled in aqueous, non-hydrocarbon, media.

Preferred ignition compositions for use in liquid-disabled oil well blasting caps are mixtures of boron with lead monoxide (PbO) and novel mixtures of boron with ferric oxide ($Fe_2O_3$). B/PbO mixtures preferably contain about 1.5–2.5 percent, and B/$Fe_2O_3$ mixtures about 6–20 percent, boron. The oxidizers PbO and $Fe_2O_3$ have melting and decomposition temperatures far above 500° C., and do not oxidize hot hydrocarbons. The B/PbO and B/$Fe_2O_3$ mixtures are less sensitive to electrostatic discharges than conventional ignition compositions, and are much less sensitive to firing current (B/PbO one-half, and B/$Fe_2O_3$ one-fourth, as sensitive) than the well-known B/$Pb_3O_4$, for example.

To facilitate the loading of ignition charges into blasting cap shells, and, in the present case, also into the bore of the porous tubular member, the ignition powder is subjected to a graining procedure to make it free-flowing. Many compositions cannot be grained unless a polymeric graining agent, e.g., polyvinyl alcohol (PVA), sodium carboxymethylcellulose (NaCMC), polysulfide rubber, or silicone rubber, is added thereto during the graining operation. The presence of a graining agent in the ignition charge may slow down the rate of fluid penetration and increase the disabling time. It may also reduce the thermal stability of the composition. Therefore, self-grained powders, e.g., self-grained B/PbO and B/$Fe_2O_3$, are preferred ignition charges. Self-graining involves mixing and slurrying the powder in water, forming a dried paste, and forcing through a sieve. If a graining agent is to be used, however, e.g., to produce harder and larger grains than can be achieved by self-graining, PVA and NaCMC (about 1%) are preferred inasmuch as their effect on the liquid penetration rate is slight, and they will admit aqueous liquids as well as oils. Powders grained with polysulfide or silicone rubber are hydrophobic and can be used only in oil-disabled caps.

Of the two preferred B/oxidizer ignition compositions, the grains in self-grained B/$Fe_2O_3$ powder are larger and harder, and therefore easier to load into small-diameter bores, than the grains in B/PbO. On the other hand, B/PbO is more sensitive to bridgewire ignition. Therefore, a low-firing-energy cap will have B/PbO around the bridgewire (charge 8) and B/$Fe_2O_3$ in the bore of the tubular porous member (charge 7).

As was stated previously, the preferred cover layer 5 also is an ignition charge. It can consist of any of the exothermic-burning compositions described above for the ignition charge(s), and, in addition, is required to have a low sensitivity to friction, as compared to the priming charge 4. It most conveniently is the same combination of components used for the bridgewire ignition charge, e.g., boron and PbO, or boron and $Fe_2O_3$. However, because a weaker-burning composition may be tolerated at this end of the ignition train, layer 5 may have a lower boron content, e.g., a boron content of about from 8 to 12% in $B/Fe_2O_3$, because the flame front from the axial-cavity charge is hot enough to reliably initiate a powder having a reduced boron content. A reduced-boron charge, while burning hot enough to ignite the priming charge, also is more readily disabled in liquid. Also, cover layer 5 should be not too highly compacted to allow a faster ingress of liquid. Charges 5, 7, and 8 are loose-loaded and essentially unpressed.

The third basic feature of the blasting cap which contributes to the cap's disablement in liquids is the presence of multiple perforations in the cap shell wall adjacent the porous tubular member. Two or more holes are drilled or punched through the shell, preferably evenly spaced around the periphery thereof to assure better distribution of the liquid throughout the porous tubular member and the ignition charge therein. The holes can be located in substantially one plane normal to the cap's longitudinal axis, or they can be in different planes provided that every hole exposes only the porous tubular member's surface and not powder in the cap's reaction train.

The holes admit liquid and bleed off interstitial air. With porous ceramic or metal tubular members, two holes drilled on opposite sides of the cap shell provide rapid disablement provided that the hole diameter is sufficiently large, e.g., preferably at least 2.5 millimeters so that air bubbles cannot stabilize themselves on the rim of the hole and thereby prevent the entry of liquid. With a fibrous tubular member, the holes are more easily made by punching, and a multitude (4 to 16) of small holes, e.g., 1.3 millimeters in diameter, in one to three circumferential rows have proved satisfactory with a tubular member of this nature.

The remaining components of the cap's reaction train, i.e., the priming charge and the base charge, can be made up of any of the materials known to the art for use in said charges. Lead azide is the most commonly used priming charge and is preferred. Other compounds which can be used include nitromannite, diazodinitrophenol, mercury fulminate, etc. Typical base charge compositions which can be used include pentaerythritol tetranitrate, RDX (cyclotrimethylenetrinitramine), trinitrotoluene, tetryl, cyclotetramethylenetetranitramine, picryl sulfone, lead azide, nitromannite, etc. For oil-well caps, high-temperature- stable explosives useful as base charges include RDX, hexanitrostilbene, tetranitro-2,3,5,6-dibenzo-1,3*a*,4,6*a*-tetraazapentalene (described in British Pat. No. 930,304), and 2,6-bis(picrylamino)- 3,5-dinitropyridine (described in U.S. Pat. No. 3,678,061).

In a non-electric blasting cap of the invention, bridgewire 9, and lead wires 10*a*,10*b* are removed and replaced, for example, by a percussion-actuated ignition assembly such as that shown in FIG. 1 of co-pending, co-assigned U.S. patent application Ser. No. 257,974, filed Apr. 27, 1981, by M. E. Yunan, now U.S. Pat. No. 4,429,632. The disclosure of this co-pending application is incorporated herein by reference. In this ignition assembly, a primer shell, e.g., a rim-fired empty primed rifle cartridge casing, forms the closure at the ignition end of the blasting cap. The primer shell has an open end and an integrally closed end which peripherally supports on its inner surface a percussion-sensitive primer charge for rim-firing (or, alternatively, for center-firing). The primer shell extends open end first into cap shell 1 to dispose its closed end adjacent, and across, the end of shell 1. Ignition charge 8 is topped with a thin layer of a flame-sensitive ignition composition adapted to be ignited in response to direct contact with flame emitted from the ignition of the percussion-sensitive primer charge. Typical of the compositions which can be used for the flame-sensitive composition are lead dinitro-o-cresylate, lead azide, and nitrocellulose, singly or in mixture with one another as well as with one or more oxidizers such as metal chlorates, nitrates, or oxides, especially red lead and potassium chlorate, or with one or more metal fuels such as boron, silicon, or magnesium; and mixtures of one or more of such metal fuels with one or more of the specified oxidizers.

Typical compositions for the percussion-sensitive primer charge are potassium chlorate, lead styphnate, mercury fulminate, antimony sulfide, lead azide, and tetracene, and mixtures of such compounds with each other or with metal oxides, materials such as sand, glass, and glue being added in certain instances. These compositions are well-known in the munitions art and often utilized as the "primer" charge in 0.22 caliber rifle cartridges.

The percussion-actuated blasting cap can be actuated by the detonation of a low-energy detonating cord transversely positioned in contact with the outside surface of the end of the primed rifle cartridge casing. Another mode of initiation is the impact of a weight or sharp object onto the percussion-sensitive end of the blasting cap.

The following examples illustrate the functioning of blasting caps of the invention in air, and their disablement by liquids.

EXAMPLE 1

The blasting cap shown in the drawing was made as follows: Shell 1 was a standard blasting cap shell, e.g., a shell made of Type 5052 aluminum alloy, 4.7 cm long and having a 0.26 cm inner diameter. Base charge 3 consisted of 450 milligrams of hexanitrostilbene, which had been placed in shell 1 and pressed therein at 890 Newtons with a pointed press pin. Priming charge 4 consisted of 320 milligrams of dextrinated lead azide, which had been loaded into shell 1 and pressed therein at 890 Newtons with a flat pin. Cover layer 5, which was loosely loaded into shell 1, consisted of 130 milligrams of a 15/85 (parts by weight) mixture of self-grained $boron/Fe_2O_3$.

Seated within shell 1 over the $B/Fe_2O_3$ cover layer was a 9.5-millimeter-long cylinder 6 made from fired, strand-extruded, crushable alumina and having a porosity of 35%. The outside diameter of the alumina cylinder was 0.025–0.050 millimeter less than the inside diameter of shell 1, thereby enabling it to be gravity loaded into the cap shell in loading machinery, and also to enable air to escape when the cap is submerged in liquid. Loosely loaded ignition charge 8 and charge 7 within the bore of tube 6, which was 2.5 millimeters in diameter, consisted of 320 milligrams of a 15/85 (parts by weight) mixture of self-grained $boron/Fe_2O_3$. Bridgewire 9 was a 0.038-mm-diameter nickel-chrome wire. Plug 2 was made of rubber.

Holes 11 and 12, 4.0 millimeters in diameter, were drilled through shell 1 at diametrically opposed locations so as to expose underlying circular areas of alumina cylinder 6.

Firing in Air

When an 0.44–0.50 ampere firing current was applied to 20 of the above-described blasting caps, all 20 of the caps detonated.

Disablement by Salt Water

After 40 of the above-described blasting caps had been immersed in saturated salt water for less than two minutes, all 40 of the caps failed to detonate.

Disablement by Oil

After 40 of the above-described blasting caps had been immersed in kerosene for less than two minutes, all 40 of the caps failed to detonate.

Thermal Stability

Forty of the above-described blasting caps were held at 260° C. for one hour, after which they were fired at the same temperature. All of the caps detonated fully, as was ascertained from the markings on aluminum witness plates.

Although the priming and base charges used in these caps give off gases at high temperatures, leading to premature excess internal pressure and blown plugs in unvented caps, the holes in the shell wall in the present cap allow the venting of gases, thereby increasing the temperature limit and the permitted time length of heat exposure of caps containing a cap-grade dextrinated lead azide priming charge and a hexanitrostilbene base charge.

Stability toward Humidity

Out of 100 of the above-described caps, 80 caps were maintained at 70° C. and 100% relative humidity for different periods of time. All 20 of the caps held under these conditions for 24 hours detonated; all 20 of the caps held under these conditions for 48 hours detonated; and all 40 of the caps held under these conditions for 10 days detonated. The other 20 caps of the 100-cap batch were fired in air immediately to establish the viability of the batch.

Stability toward Electrostatic Energy

Forty of the above-described blasting caps were subjected to increasingly higher discharges of 4, 6, 8, 10, 15, 20, and 25 kilovolts from 900 picofarads in the double-leg to shell mode. None of the caps fired at 15 kilovolts or lower, 19 fired at 20 kilovolts, 18 fired at 25 kilovolts, and 3 did not fire. Thus, all 40 caps withstood 101 mWs (milliwatt-seconds) energy and fired at 180 or 281 mWs.

The 15/85 weight ratio of boron to ferric oxide used in the ignition composition of the above-exemplified blasting cap allowed the composition to be ignited reliably with a Ni-Cr bridgewire at a capacitor discharge firing energy of 10 mWs/ohm (0.5 A minimum firing current). This weight ratio is preferred. For a composition having a 12/88 weight ratio, 12 mWs/ohm was required with an 0.038-mm-diameter Ni-Cr wire, 20 mWs/ohm with an 0.043-mm-diameter Ni-Cr wire, 50 mWs/ohm with an 0.048-mm-diameter Ni-Cr wire, and 35 mWs/ohm with an 0.040-mm-diameter Pt-W wire.

EXAMPLE 2

The blasting cap described in Example 1 was modified as follows: Base charge 3 consisted of 400 milligrams of RDX, and cylinder 6 was made from eight 1.8-millimeter-thick circular layers of "Manniglas" (Manning Paper Company, Troy, New York), a fiber glass, which had been provided with an axial cavity by pushing a tapered pin through them. Charges 7 and 8 consisted of 650 milligrams of a polysulfide-grained mixture of boron/red lead. Bridgewire 9 had a diameter of 0.048 millimeters. Six uniformly spaced 1.5-millimeter-diameter holes were punched radially through the cap shell so as to expose the glass fiber cylinder.

This blasting cap detonated with full strength when initiated in air with a firing current of less than one ampere. It failed after having been submerged in saturated salt water or kerosene for less than one minute.

I claim:

1. In a blasting cap comprising a tubular metal shell integrally closed at one end and containing, in sequence, from said closed end, a base charge of a detonating explosive composition and a priming charge of a heat-sensitive detonating explosive composition, and being closed at its opposite end by an ignition assembly containing an ignition charge of a heat- or flame-sensitive exothermic-burning composition for igniting said priming charge, the improvement comprising a porous tubular member seated within said metal shell between said priming charge and said ignition charge, said porous tubular member having an axial perforation containing a substantially continuous charge of a heat-sensitive exothermic-burning composition communicating with said priming charge and with said ignition charge in said ignition assembly so as to provide a substantially continuous train of charges from said ignition charge in said ignition assembly to said base charge, the sidewall of said tubular metal shell being provided with multiple perforations adjacent said porous tubular member seated therein whereby liquids may gain access to said porous tubular member and the charge of exothermic-burning composition contained therein.

2. A blasting cap of claim 1 wherein a loosely loaded charge of a heat-sensitive exothermic-burning composition is present between said porous tubular member and said priming charge.

3. A blasting cap of claim 1 wherein said porous tubular member is a sintered, compacted ceramic or metal powder.

4. A blasting cap of claim 3 wherein said porous tubular member is formed from alumina.

5. A blasting cap of claim 1 wherein said porous tubular member is formed from a fibrous material.

6. A blasting cap of claim 1 wherein said charge of exothermic-burning composition in said axial perforation in said porous tubular member, and said ignition charge in said ignition assembly, are readily penetrated by liquid hydrocarbons.

7. A blasting cap of claim 6 wherein said charges are non-oxidative with respect to said hydrocarbons at a temperature of 350° C.

8. A blasting cap of claim 7 wherein said ignition assembly comprises an ignition charge of a heat-sensitive exothermic-burning composition having embedded therein a high-resistance bridge wire connected to a pair of leg wires having their ends supported inside said shell by a plug crimped into the end of said shell.

9. A blasting cap of claim 8 wherein said charges are powder mixtures of boron with an oxide selected from the group consisting of ferric oxide and lead monoxide.

10. A blasting cap of claim 9 wherein said charge in said axial perforation is a mixture of boron and ferric oxide.

11. A blasting cap of claim 9 wherein said ignition charge in said ignition assembly is a mixture of boron and ferric oxide.

12. A blasting cap of claim 7 wherein said priming charge is lead azide, and said base charge is a detonating explosive selected from the group consisting of RDX, hexanitrostilbene, tetranitro-2,3,5,6-dibenzo-1,3*a*,4,6*a*-tetraazapentalene, and 2,6-bis(picrylamino)-3,5-dinitropyridine.

13. A method of making a blasting cap comprising:

(a) sequentially loading into a tubular metal shell, from an integrally closed end thereof, a base charge of a detonating explosive composition and a priming charge of a heat-sensitive detonating explosive composition;

(b) positioning a layer of fibrous material adjacent said priming charge;

(c) forcing a pin into said layer of fibrous material so as to punch an axial perforation therein and convert said layer into a tubular configuration;

(d) introducing a heat-sensitive exothermic-burning powder into said perforation;

(e) positioning at the opposite end of said tubular metal shell a plug closure and an ignition assembly including an ignition charge of a heat- or flame-sensitive exothermic-burning composition for igniting said priming charge, said ignition charge and said priming charge communicating with said powder in said perforation; and (f) punching holes in the wall of said tubular metal shell adjacent said tubular layer of fibrous material.

* * * * *